US010287645B2

(12) United States Patent
Kondo et al.

(10) Patent No.: US 10,287,645 B2
(45) Date of Patent: May 14, 2019

(54) METHOD FOR PRODUCING HIGH-STRENGTH STEEL MATERIAL EXCELLENT IN SULFIDE STRESS CRACKING RESISTANCE

(71) Applicant: NIPPON STEEL & SUMITOMO METAL CORPORATION, Tokyo (JP)

(72) Inventors: Keiichi Kondo, Tokyo (JP); Yuji Arai, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 869 days.

(21) Appl. No.: 14/382,081

(22) PCT Filed: Feb. 26, 2013

(86) PCT No.: PCT/JP2013/054866
§ 371 (c)(1),
(2) Date: Aug. 29, 2014

(87) PCT Pub. No.: WO2013/133076
PCT Pub. Date: Sep. 12, 2013

(65) Prior Publication Data

US 2015/0041030 A1 Feb. 12, 2015

(30) Foreign Application Priority Data

Mar. 7, 2012 (JP) ..... 2012-049970

(51) Int. Cl.

| | |
|---|---|
| ***C21D 8/10*** | (2006.01) |
| ***C21D 8/04*** | (2006.01) |
| ***C21D 9/08*** | (2006.01) |
| ***C22C 38/00*** | (2006.01) |
| ***C22C 38/50*** | (2006.01) |
| ***C22C 38/54*** | (2006.01) |
| ***C22C 38/02*** | (2006.01) |
| ***C22C 38/04*** | (2006.01) |
| ***C22C 38/06*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |
| ***C21D 9/46*** | (2006.01) |
| ***C21D 1/18*** | (2006.01) |
| ***C22C 38/44*** | (2006.01) |
| ***C22C 38/46*** | (2006.01) |
| ***C22C 38/48*** | (2006.01) |

(52) U.S. Cl.

CPC ..... *C21D 8/105* (2013.01); *C21D 1/18* (2013.01); *C21D 8/10* (2013.01); *C21D 9/08* (2013.01); *C21D 9/46* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/22* (2013.01); *C22C 38/24* (2013.01); *C22C 38/26* (2013.01); *C22C 38/28* (2013.01); *C22C 38/32* (2013.01); *C22C 38/44* (2013.01); *C22C 38/46* (2013.01); *C22C 38/48* (2013.01); *C22C 38/50* (2013.01); *C22C 38/54* (2013.01)

(58) Field of Classification Search

CPC ..... C21D 8/105; C21D 1/18; C21D 8/0463
See application file for complete search history.

(56) References Cited

U.S. PATENT DOCUMENTS

| | | | | |
|---|---|---|---|---|
| 5,938,865 | A * | 8/1999 | Kondo et al. | 148/593 |
| 2010/0068549 | A1* | 3/2010 | Agazzi et al. | 428/586 |
| 2012/0042992 | A1 | 2/2012 | Kondo et al. | |

FOREIGN PATENT DOCUMENTS

| | | |
|---|---|---|
| CN | 1189111 | 7/1998 |
| CN | 102365376 | 2/2010 |
| JP | 59-232220 | 12/1984 |
| JP | 60-009824 | 1/1985 |
| JP | 5-009571 | 1/1993 |
| JP | 6-220536 | 8/1994 |
| JP | 09-059718 | 3/1997 |
| JP | 2000-178682 | 6/2000 |
| JP | 2000-297344 | 10/2000 |
| JP | 2001-131698 | 5/2001 |
| JP | 2001-172739 | 6/2001 |
| JP | 9-249935 | 9/2007 |
| UA | 90947 | 6/2010 |
| WO | 96/36742 | 11/1996 |
| WO | 2010/113953 | 10/2010 |
| WO | 2010/150915 | 12/2010 |

* cited by examiner

*Primary Examiner* — Matthew E. Hoban
(74) *Attorney, Agent, or Firm* — Clark & Brody

(57) ABSTRACT

A steel has a chemical composition consisting of, by mass percent, C: 0.15-0.65%, Si: 0.05-0.5%, Mn: 0.1-1.5%, Cr: 0.2-1.5%, Mo: 0.1-2.5%, Ti: 0.005-0.50%, Al: 0.001-0.50%, and optionally at least one element selected from Nb: ≤0.4%, V: ≤0.5%, and B: ≤0.01%, Ca: ≤0.005%, Mg: ≤0.005%, and REM: ≤0.005%, and the balance of Fe and impurities, wherein Ni, P, S, N and O as impurities are Ni: ≤0.1%, P: ≤0.04%, S: ≤0.01%, N: ≤0.01%, and O: ≤0.01%. The steel is hot-worked into a shape and then sequentially subjected to heating the steel to a temperature exceeding the $Ac_1$ transformation point and lower than the $Ac_3$ transformation point and cooling. Then, a step of reheating the steel to a temperature not lower than the $Ac_3$ transformation point and quenching the steel by rapid cooling, and a step of tempering the steel at a temperature not higher than the $Ac_1$ transformation point are performed.

10 Claims, No Drawings

METHOD FOR PRODUCING HIGH-STRENGTH STEEL MATERIAL EXCELLENT IN SULFIDE STRESS CRACKING RESISTANCE

TECHNICAL FIELD

The present invention relates to a method for producing a high-strength steel material excellent in sulfide stress cracking resistance. More particularly, the present invention relates to a method for producing a high-strength steel material excellent in sulfide stress cracking resistance, which steel material is especially suitable for an oil-well steel pipe and the like such as a casing and a tubing for oil well and gas well. Still more particularly, the present invention relates to a low-cost method for producing a low-alloy high-strength steel material which is excellent in strength and sulfide stress cracking resistance, and by which the improvement in toughness due to the refinement of prior-austenite grains can be expected.

BACKGROUND ART

As oil wells and gas wells (hereinafter, as a general term of oil wells and gas wells, referred simply to as "oil wells") become deeper, oil-well steel pipes (hereinafter, referred to as "oil-well pipes") are required to have higher strength.

To meet this requirement, conventionally, oil-well pipes of 80 ksi class, that is, having a yield stress (hereinafter, abbreviated as "YS") of 551 to 655 MPa (80 to 95 ksi) or oil-well pipes of 95 ksi class, that is, having a YS of 655 to 758 MPa (95 to 110 ksi) have been used widely. Further, recently, oil-well pipes of 110 ksi class, that is, having a YS of 758 to 862 MPa (110 to 125 ksi), and further oil-well pipes of 125 ksi class, that is, having a YS of 862 to 965 MPa (125 to 140 ksi) have begun to be used.

Further, the oil and gas in most of the deep wells having been developed recently contain corrosive hydrogen sulfide. In such an environment, hydrogen embrittlement called sulfide stress cracking (hereinafter, referred also to as "SSC") occurs, and resultantly the oil-well pipe is sometimes broken. It is widely known that with the increase in strength of steel, the susceptibility to SSC increases.

Therefore, in developing high-strength oil-well pipes, not only the material design of high-strength steel is required to be made but also the steel is required to have SSC resistance. Especially in developing high-strength oil-well pipes, the prevention of SSC is the biggest problem. The sulfide stress cracking is sometimes referred also to as sulfide stress corrosion cracking ("SSCC").

As the method for preventing SSC of low-alloy oil-well pipes, methods of (1) high purification of steel, (2) mode control of carbides, and (3) refinement of crystal grains have been known.

Concerning the high purification of steel, for example, Patent Documents 1 and 2 propose methods for improving the SSC resistance by mean of restriction of the sizes of nonmetallic inclusions to specific ones.

Concerning the mode control of carbides, for example, Patent Document 3 discloses a technique in which the ratio of MC-type carbides to total carbides is 8 to 40 mass % in addition to the restriction of the total amount of carbides to 2 to 5 mass % to tremendously improve the SSC resistance.

Concerning the refinement of crystal grains, for example, Patent Document 4 discloses a technique in which the crystal grains are made fine by performing quenching treatment two times or more on a low-alloy steel to improve the SSCC resistance. Patent Document 5 also discloses a technique in which the crystal grains are made fine by the same treatment as that in Patent Document 4 to improve the toughness.

Conventionally, in producing low-alloy steel materials in the field of seamless steel pipes for oil well and the like pipes, to attain strength properties and/or toughness, heat treatment of quenching and tempering has often been performed after the finish of hot rolling such as hot pipe making. As a method for heat treatment of quenching and tempering of the seamless steel pipe for oil well, conventionally, a so-called "reheat quenching process" has generally been performed, in which process, a steel pipe having been hot rolled is reheated in an offline heat treatment furnace to a temperature not lower than the $Ac_3$ transformation point and is quenched, and further is tempered at a temperature not higher than the $Ac_1$ transformation point.

However, in recent years, from the viewpoints of process saving and energy saving, there has also been performed a process in which a steel pipe having been hot rolled is directly quenched from a temperature not lower than the $Ar_3$ transformation point and thereafter is tempered (a so-called "direct quenching process") or further a process in which a steel pipe having been hot rolled is sequentially soaked (hereinafter, especially referred also to as "supplementarily heated") at a temperature not lower than the $Ar_3$ transformation point and thereafter is quenched from a temperature not lower than the $Ar_3$ transformation point and thereafter is tempered (a so-called "inline heat treatment process" or "inline quenching process").

As disclosed in Patent Documents 4 and 5, it has been widely known that a close relationship exists between the prior-austenite grains of low-alloy steel and the SSC resistance and toughness, and the SSC resistance and toughness are decreased remarkably by the coarsening of grains.

In the case where the "direct quenching process" is adopted for the purpose of process saving and energy saving, the prior-austenite grains coarsen, so that it sometimes becomes difficult to produce a seamless steel pipe excellent in toughness and SSC resistance. The above-described "inline heat treatment process" somewhat solves this problem, but is not necessarily comparable to the "reheat quenching process".

The reason for this is thought to be that in the simple "direct quenching process" and "inline heat treatment process", in the case where only tempering is performed as the heat treatment of the postprocessing, there does not exist a process of reverse transformation from ferrite of body-centered cubic structure to austenite of face-centered cubic structure.

To solve the above-described problem of coarsening of crystal grains, Patent Documents 6 and 7 propose methods in which a steel pipe having been directly quenched and a steel pipe having been quenched by inline heat treatment, respectively, are reheated and quenched from a temperature not lower than the Ara transformation point before the final tempering treatment.

In Patent Documents 4 and 5, tempering is performed at a temperature not higher than the $Ac_1$ transformation point in between the reheat quenching treatments of plural times, and in Patent Documents 6 and 7, tempering is performed at a temperature not higher than the $Ac_1$ transformation point in between the direct quenching treatment and quenching treatment performed in inline heat treatment, respectively, and the reheat quenching treatment.

LIST OF PRIOR ART DOCUMENTS

Patent Document

Patent Document 1: JP2001-172739A
Patent Document 2: JP2001-131698A
Patent Document 3: JP2000-178682A
Patent Document 4: JP59-232220A
Patent Document 5: JP60-009824A
Patent Document 6: JP6-220536A
Patent Document 7: WO96/36742

DISCLOSURE OF THE INVENTION

Problems to be Solved by the Invention

By the techniques for restricting the sizes of nonmetallic inclusions to specific ones that are proposed in Patent Documents 1 and 2, an excellent SSC resistance can be attained. However, since the steel must be purified, the production cost sometimes increases.

Also, by the technique for controlling the modes of carbides that is proposed in Patent Document 3, a very excellent SSC resistance can be attained. However, the contents of Cr and Mo are restricted to restrain the formation of $M_{23}C_6$-type carbides. Therefore, the hardenability is restricted, so that for a thick-wall material, there is a possibility of insufficient hardenability.

A process comprising direct quenching process or inline heat treatment process, and then reheating and quenching from a temperature not lower than the $Ar_3$ transformation point before the final tempering makes the prior austenite grains more refined, thereby improving the SSC resistance of the steel, compared with the case where the final tempering is performed following the direct quenching or the inline heat treatment, or the case where the steel pipe is once air-cooled close to room temperature, and thereafter the steel pipe is subjected to a reheat-and-quenching treatment and tempering treatment.

Even in the case where after being subjected to the direct quenching treatment or the inline heat treatment, the steel pipe is reheated and quenched from a temperature not lower than the $Ar_3$ transformation point before the final tempering treatment as described above, the refinement of prior-austenite grains is still insufficient as compared with the case where the reheat quenching treatment is performed two times as proposed in Patent Documents 4 and 5.

Therefore, by the technique in which the steel pipe having been directly quenched is reheated and quenched from a temperature not lower than the $Ar_3$ transformation point before the final tempering treatment, which technique is disclosed in Patent Document 6, a sufficient SSC resistance cannot necessarily be attained.

Similarly, even if the steel pipe having been quenched by inline heat treatment is reheated and quenched from a temperature not lower than the Ara transformation point before the final tempering treatment as proposed in Patent Document 7, a sufficient SSC resistance cannot sometimes be attained.

Therefore, when an attempt is made to realize the refinement of crystal grains that is sufficient as a high-strength oil-well steel pipe, the reheat quenching treatment performed two times or more as disclosed in Patent Documents 4 and 5 is significant. However, the reheat quenching treatment performed two times or more leads to the rise in production cost.

Patent Documents 4 and 7 propose techniques in which the crystal grains are made ultrafine by increasing the temperature rising rate at the time of reheat quenching. In the techniques, however, the equipment must be modified on a large scale because the heating means comes to consist of induction heating or the like.

The present invention was made in view of the above situation, and accordingly an objective thereof is to provide a low-cost method for producing a high-strength steel material excellent in SSC resistance. Particularly, the objective of the present invention is to provide a method for producing a high-strength steel material in which the refinement of prior-austenite grains is realized by an economically efficient means, whereby the excellent SSC resistance and the improvement in toughness can be expected. The term "high strength" in the present invention means that the YS is 655 MPa (95 ksi) or higher, preferably 758 MPa (110 ksi) or higher, and further preferably 862 MPa (125 ksi) or higher.

Means for Solving the Problems

As described above, after being subjected to the direct quenching treatment or the quenching treatment of inline heat treatment, a steel is further reheated to a temperature not lower than the $Ac_3$ transformation point and is quenched, whereby the prior-austenite grains can be made fine. In the case where the steel having been quenched is further repeatedly quenched, after the preceding quenching treatment, intermediate tempering is often performed at a temperature not higher than the $Ac_1$ transformation point. This intermediate tempering treatment has an effect of preventing delayed cracking such as so-called "season cracking" occurring in a quenched steel.

However, the intermediate tempering must be performed under proper conditions. In the case where the temperature of intermediate tempering is too low or the heating time is too short, a sufficient effect of restraining season cracking cannot be achieved in some cases. Inversely, even if the temperature is not higher than the $Ac_1$ transformation point, in the case where the temperature of intermediate tempering is too high or the heating time is too long, the effect of making crystal grains fine is lost even if the reheat quenching is performed after the intermediate tempering treatment, and sometimes, the advantageous effect of improving the SSC resistance disappears.

Accordingly, the present inventors carried out various studies on a low-cost method for producing a high-strength steel material by which method the steel material has a sufficient effect of restraining season cracking and simultaneously has an excellent SSC resistance due to the realization of refinement of prior-austenite grains.

As the result, the present inventors obtained findings that if intermediate tempering treatment, which has been supposed to have to be performed at a temperature not higher than the $Ac_1$ transformation point to improve the properties of the quenched steel material, is performed at a temperature in the two-phase region of ferrite and austenite exceeding the $Ac_1$ transformation point, the prior-austenite grains are made fine remarkably when the next reheat quenching treatment is performed.

Moreover, the present inventors obtained quite novel findings that if heat treatment is performed at a temperature in the above-described two-phase region of ferrite and austenite, even for a steel that has not been quenched, for example, a steel that has been cooled at a cooling rate of air cooling or the like after being hot-worked into a desired shape, if the steel is next heated to a temperature in a proper austenite zone and is quenched, the prior-austenite grains are made fine remarkably.

The present invention was completed based on the above-described findings, and involves the methods for producing a high-strength steel material excellent in sulfide stress cracking resistance described below. Hereinafter, in some cases, the methods are referred simply to as "the present invention (1)" to "the present invention (7)". Also, in some cases, the present inventions (1) to (7) are generally named "the present invention".

(1) A method for producing a high-strength steel material excellent in sulfide stress cracking resistance, wherein a steel that has a chemical composition consisting of, by mass percent, C: 0.15 to 0.65%, Si: 0.05 to 0.5%, Mn: 0.1 to 1.5%, Cr: 0.2 to 1.5%, Mo: 0.1 to 2.5%, Ti: 0.005 to 0.50%, Al: 0.001 to 0.50%, and the balance of Fe and impurities, wherein Ni, P, S, N and O among the impurities are Ni: 0.1% or less, P: 0.04% or less, S: 0.01% or less, N: 0.01% or less, and O: 0.01% or less, and that has been hot-worked into a desired shape is sequentially subjected to the steps of the following [1] to [3]:

[1] A step of heating the steel to a temperature exceeding the $Ac_1$ transformation point and lower than the $Ac_3$ transformation point and cooling the steel;

[2] A step of reheating the steel to a temperature not lower than the $Ac_3$ transformation point and quenching the steel by rapid cooling; and

[3] A step of tempering the steel at a temperature not higher than the $Ac_1$ transformation point.

(2) A method for producing a high-strength steel material excellent in sulfide stress cracking resistance, wherein a steel that has a chemical composition consisting of, by mass percent, C: 0.15 to 0.65%, Si: 0.05 to 0.5%, Mn: 0.1 to 1.5%, Cr: 0.2 to 1.5%, Mo: 0.1 to 2.5%, Ti: 0.005 to 0.50%, Al: 0.001 to 0.50%, at least one selected from the elements shown in (a) and (b), and the balance of Fe and impurities, wherein Ni, P, S, N and O among the impurities are Ni: 0.1% or less, P: 0.04% or less, S: 0.01% or less, N: 0.01% or less, and O: 0.01% or less, and that has been hot-worked into a desired shape is sequentially subjected to the steps of the following [1] to [3]:

[1] A step of heating the steel to a temperature exceeding the $Ac_1$ transformation point and lower than the $Ac_3$ transformation point and cooling the steel;

[2] A step of reheating the steel to a temperature not lower than the $Ac_3$ transformation point and quenching the steel by rapid cooling; and [3] A step of tempering the steel at a temperature not higher than the $Ac_1$ transformation point.

(a) Nb: 0.4% or less, V: 0.5% or less, and B: 0.01% or less;

(b) Ca: 0.005% or less, Mg: 0.005% or less, and REM: 0.005% or less.

(3) The method for producing a high-strength steel material excellent in sulfide stress cracking resistance according to (1) or (2), wherein the steel having the chemical composition according to (1) or (2) is hot-finished into a seamless steel pipe and is air cooled, and thereafter is sequentially subjected to the steps of [1] to [3].

(4) The method for producing a high-strength steel material excellent in sulfide stress cracking resistance according to (1) or (2), wherein after the steel having the chemical composition according to (1) or (2) has been hot-finished into a seamless steel pipe, the steel is supplementarily heated at a temperature not lower than the $Ar_3$ transformation point and not higher than 1050° C. in line, and after being quenched from a temperature not lower than the $Ar_3$ transformation point, the steel is sequentially subjected to the steps of [1] to [3].

(5) The method for producing a high-strength steel material excellent in sulfide stress cracking resistance according to (1) or (2), wherein after the steel having the chemical composition according to (1) or (2) has been hot-finished into a seamless steel pipe, the steel is directly quenched from a temperature not lower than the $Ar_3$ transformation point, and thereafter is sequentially subjected to the steps of [1] to [3].

(6) The method for producing a high-strength steel material excellent in sulfide stress cracking resistance according to (4), wherein the heating in step [1] is performed by a heating apparatus connected to an apparatus for quenching of inline heat treatment.

(7) The method for producing a high-strength steel material excellent in sulfide stress cracking resistance according to (5), wherein the heating in step [1] is performed by a heating apparatus connected to a quenching apparatus that performs direct quenching.

Advantageous Effects of the Invention

According to the present invention, since the refinement of prior-austenite grains can be realized by an economically efficient means, a high-strength steel material excellent in SSC resistance can be obtained at a low cost. Also, by the present invention, a high-strength low-alloy steel seamless oil-well pipe excellent in SSC resistance can be produced at a relatively low cost. Further, according to the present invention, the improvement in toughness due to the refinement of prior-austenite grains can be expected.

MODE FOR CARRYING OUT THE INVENTION

Hereunder, the requisites of the present invention are explained in detail.

(A) Chemical Composition

First, in item (A), explanation is given of the chemical composition of a steel used in the production method of the present invention and the reasons why the composition range is restricted. In the explanation below, symbol "%" concerning the content of each element means "percent by mass".

C: 0.15 to 0.65%

C (Carbon) is an element necessary to enhance the hardenability and to improve the strength. However, if the C content is less than 0.15%, the effect of enhancing the hardenability is poor, and a sufficient strength cannot be attained. On the other hand, if the C content exceeds 0.65%, the tendency for a quenching crack to be generated at the quenching time is remarkable. Therefore, the C content is 0.15 to 0.65%. The lower limit of the C content is preferably 0.20%, further preferably 0.23%. Also, the upper limit of the C content is preferably 0.45%, further preferably 0.30%.

Si: 0.05 to 0.5%

Si (Silicon) is necessary to deoxidize steel, and also has an action for enhancing the temper softening resistance and for improving the SSC resistance. For the purpose of deoxidation and improvement in SSC resistance, 0.05% or more of Si must be contained. However, if Si is contained excessively, steel is embrittled, and additionally the SSC resistance is rather decreased. In particular, if the Si content exceeds 0.5%, the toughness and SSC resistance are decreased significantly. Therefore, the Si content is 0.05 to 0.5%. The lower and upper limits of the Si content are preferably 0.15% and 0.35%, respectively.

Mn: 0.1 to 1.5%

Mn (Manganese) is contained to deoxidize and desulfurize steel. However, if the Mn content is less than 0.1%, the above-described effects are poor. On the other hand, if the Mn content exceeds 1.5%, the toughness and SSC resistance are decreased. Therefore, the Mn content is 0.1 to 1.5%. The lower limit of the Mn content is preferably 0.15%, further preferably 0.20%. Also, the upper limit of the Mn content is preferably 0.85%, further preferably 0.55%.

Cr: 0.2 to 1.5%

Cr (Chromium) is an element for ensuring the hardenability and for improving the strength and SSC resistance. However, if the Cr content is less than 0.2%, sufficient effects cannot be achieved. On the other hand, if the Cr content exceeds 1.5%, the SSC resistance is rather decreased, and further a decrease in toughness is brought about. Therefore, the Cr content is 0.2 to 1.5%. The lower limit of the Cr content is preferably 0.35%, and more preferably 0.45%. The upper limit of the Cr content is preferably 1.28%, and more preferably 1.2%.

Mo: 0.1 to 2.5%

Mo (Molybdenum) enhances the hardenability and ensures the strength, and also improves the temper softening resistance. Therefore, due to the containing of Mo, tempering at high temperatures can be performed, and resultantly, the shape of carbides turns spherical, and the SSC resistance is improved. However, if the Mo content is less than 0.1%, these effects are poor. On the other hand, if the Mo content exceeds 2.5%, despite the fact that the raw material cost increases, the above-described effects somewhat saturates. Therefore, the Mo content is 0.1 to 2.5%. The lower limit of the Mo content is preferably 0.3%, further preferably 0.4%. Also, the upper limit of the Mo content is preferably 1.5%, further preferably 1.0%.

Ti: 0.005 to 0.50%

Ti (Titanium) has an action for improving the hardenability by immobilizing N, which is an impurity in steel, and by causing B to exist in a dissolved state in steel at the time of quenching. Also, Ti has an effect of preventing the coarsening of crystal grains and the abnormal grain growth at the time of reheat quenching by precipitating as fine carbonitrides in the process of temperature rise for reheat quenching. However, if the Ti content is less than 0.005%, these effects are low. On the other hand, if the Ti content exceeds 0.50%, a decrease in toughness is brought about. Therefore, the Ti content is 0.005 to 0.50%. The lower limit of the Ti content is preferably 0.010%, further preferably 0.012%. Also, the upper limit of the Ti content is preferably 0.10%, further preferably 0.030%.

Al: 0.001 to 0.50%

Al (Aluminum) is an element effective in deoxidizing steel. However, if the Al content is less than 0.001%, a desired effect cannot be achieved, and if the Al content exceeds 0.50%, the amount of inclusions increases and the toughness decreases, and also the SSC resistance is decreased by the coarsening of inclusions. Therefore, the Al content is 0.001 to 0.50%. The lower and upper limits of the Al content are preferably 0.005% and 0.05%, respectively. The above-described Al content means the amount of sol. Al (acid-soluble Al).

A chemical composition of the steel used in the production method of the present invention (specifically, the chemical composition of the steel according to the present invention (1)) consists of the above-described elements and the balance of Fe and impurities, wherein Ni, P, S, N and O among the impurities are Ni: 0.1% or less, P: 0.04% or less, S: 0.01% or less, N: 0.01% or less, and O: 0.01% or less.

The "impurities" described herein mean elements that mixedly enter on account of various factors in the production process including raw materials such as ore or scrap when a steel is produced on an industrial scale, and are allowed to be contained within the range such that the elements do not exert an adverse influence on the present invention.

Hereunder, explanation is given of Ni, P, S, N and O (oxygen) in the impurities.

Ni: 0.1% or less

Ni (Nickel) decreases the SSC resistance. In particular, if the Ni content exceeds 0.1%, the decrease in SSC resistance is remarkable. Therefore, the content of Ni in the impurities is 0.1% or less. The Ni content is preferably 0.05% or less, and more preferably 0.03% or less.

P: 0.04% or less

P (Phosphorus) segregates at the grain boundary, and decreases the toughness and SSC resistance. In particular, if the P content exceeds 0.04%, the decrease in toughness and SSC resistance is remarkable. Therefore, the content of P in the impurities is 0.04% or less. The upper limit of the content of P in the impurities is preferably 0.025%, further preferably 0.015%.

S: 0.01% or less

S (Sulfur) produces coarse inclusions, and decreases the toughness and SSC resistance. In particular, if the S content exceeds 0.01%, the decrease in toughness and SSC resistance is remarkable. Therefore, the content of S in the impurities is 0.01% or less. The upper limit of the content of S in the impurities is preferably 0.005%, further preferably 0.002%.

N: 0.01% or less

N (Nitrogen) combines with B, and prevents the advantageous effect of improving the hardenability of B. Also, if N is contained excessively, N produces coarse inclusions together with Al, Ti, Nb, etc., and has a tendency to decrease the toughness and SSC resistance. In particular, if the N content exceeds 0.01%, the decrease in toughness and SSC resistance is remarkable. Therefore, the content of N in the impurities is 0.01% or less. The upper limit of the content of N in the impurities is preferably 0.005%.

O: 0.01% or less

O (Oxygen) produces inclusions together with Al, Si, etc. By the coarsening of inclusions, the toughness and SSC resistance are decreased. In particular, if the O content exceeds 0.01%, the decrease in toughness and SSC resistance is remarkable. Therefore, the content of O in the impurities is 0.01% or less. The upper limit of the content of O in the impurities is preferably 0.005%.

Another chemical composition of the steel used in the production method of the present invention (specifically, the chemical composition of the steel according to the present invention (2)) further comprises at least one element of Nb, V, B, Ca, Mg and REM (rare earth metal).

The "REM" described herein is a general term of a total of 17 elements of Sc, Y and lanthanoids, and the content of REM means the total content of one or more element(s) of REM.

Hereunder, explanation is given of the operational advantages of Nb, V, B, Ca, Mg and REM and the reasons why the composition range is restricted.

(a) Nb: 0.4% or less, V: 0.5% or less, and B: 0.01% or less

All of Nb, V and B have an action for improving the SSC resistance. Therefore, in the case where it is desired to attain a higher SSC resistance, these elements may be contained. Hereunder, Nb, V and B are explained.

Nb: 0.4% or less

Nb (Niobium) is an element that precipitates as fine carbo-nitrides, and has an effect of making the prior-austenite grains fine and thereby improving the SSC resistance. Therefore, Nb may be contained as necessary. However, if the Nb content exceeds 0.4%, the toughness deteriorates. Therefore, the content of Nb, if contained, is 0.4% or less. The content of Nb, if contained, is preferably 0.1% or less.

On the other hand, in order to stably achieve the above-described effect of Nb, the content of Nb, if contained, is preferably 0.005% or more, and further preferably 0.01% or more.

V: 0.5% or less

V (Vanadium) precipitates as carbides (VC) when tempering is performed, and enhances the temper softening resistance, so that V enables tempering to be performed at high temperatures. As the result, V has an effect of improving the SSC resistance. Also, V has an effect of restraining the production of needle-form $Mo_2C$, which becomes the starting point of occurrence of SSC when the Mo content is high. Further, by containing V in complex with Nb, a greater SSC resistance can be attained. Therefore, V may be contained as necessary. However, if the V content exceeds 0.5%, the toughness decreases. Therefore, the content of V, if contained, is 0.5% or less. The content of V, if contained, is preferably 0.2% or less.

On the other hand, in order to stably achieve the above-described effect of V, the content of V, if contained, is preferably 0.02% or more. In particular, in the case where the steel contains 0.68% or more of Mo, to restrain the production of needle-form $Mo_2C$, the above-described amount of V is preferably contained complexly.

B: 0.01% or less

B (Boron) is an element having effects of increasing the hardenability and improving the SSC resistance. Therefore, B may be contained as necessary. However, if the B content exceeds 0.01%, the SSC resistance rather decreases, and further the toughness also decreases. Therefore, the content of B, if contained, is 0.01% or less. The content of B, if contained, is preferably 0.005% or less, and further preferably 0.0025% or less.

On the other hand, in order to stably achieve the above-described effects of B, the content of B, if contained, is preferably 0.0001% or more, and further preferably 0.0005% or more.

However, the above-described effects of B appear in the case where B is caused to exist in a dissolved state in steel. Therefore, in the case where B is contained, the chemical composition is preferably regulated so that, for example, Ti of an amount such as to be capable of immobilizing N having a high affinity with B as nitrides is contained.

(b) Ca: 0.005% or less, Mg: 0.005% or less, and REM: 0.005% or less

All of Ca, Mg and REM react with S existing as an impurity in steel to form sulfides, and has an action for improving the shapes of inclusions and thereby increasing the SSC resistance. Therefore, these elements may be contained as necessary. However, if either element is contained exceeding 0.005%, the SSC resistance rather decreases, also a decrease in toughness is brought about, and further defects are liable to occur often on the surface of steel. Therefore, the content of any of Ca, Mg and REM, if contained, is 0.005% or less. The content of any of these elements, if contained, is preferably 0.003% or less.

On the other hand, in order to stably achieve the above-described effect of Ca, Mg and REM, the content of any of these elements, if contained, is preferably 0.001% or more.

As already described, the "REM" is a general term of a total of 17 elements of Sc, Y and lanthanoids, and the content of REM means the total content of one or more element(s) of REM.

The REM is generally contained in a form of misch metal. Therefore, REM may be added, for example, in a form of misch metal, and may be contained so that the amount of REM is in the above-described range.

Only one element of any of Ca, Mg and REM can be contained, or two or more elements can be contained complexly. The total content of these elements is preferably 0.006% or less, and further preferably 0.004% or less.

(B) Production Method

Next, in item (B), detailed explanation is given of the method for producing a high-strength steel material excellent in sulfide stress cracking resistance of the present invention.

In the method for producing a high-strength steel material excellent in sulfide stress cracking resistance in accordance with the present invention, the steel that has the chemical composition described in item (A) and that has been hot-worked into a desired shape is subjected to the following steps sequentially:

[1] A step of heating the steel to a temperature exceeding the $Ac_1$ transformation point and lower than the $Ac_3$ transformation point and cooling the steel;

[2] A step of reheating the steel to a temperature not lower than the $Ac_3$ transformation point and quenching the steel by rapid cooling; and [3] A step of tempering the steel at a temperature not higher than the $Ac_1$ transformation point.

By performing the steps of items [1] to [3] sequentially, the refinement of prior-austenite grains can be realized, the high-strength steel material excellent in SSC resistance can be obtained at a low cost, and further the improvement in toughness due to the refinement of prior-austenite grains can be expected.

If the steel has the chemical composition described in item (A) and has been hot-worked into a desired shape, the production history before the performance of step [1] is not subject to any specific restriction. For example, if the steel is produced by the ordinary process in which an ingot or a cast piece is formed after melting, and the steel is hot-worked into a desired shape by any method such as hot-rolling or hot-forging, after the hot working for forming a desired shape, the steel may be cooled at a low cooling rate as in air cooling, or may be cooled at a high cooling rate as in water cooling.

The reason for this is as described below. Even if any treatment is performed after the hot working for forming a desired shape, by sequentially performing the steps [1] to [3] thereafter, a micro-structure consisting mainly of fine tempered martensite is formed after the tempering treatment at a temperature not higher than the $Ac_1$ transformation point in step [3] has been finished.

The heating in step [1] must be performed at a temperature exceeding the $Ac_1$ transformation point and lower than the $Ac_3$ transformation point. In the case where the heating temperature deviates from the above-described temperature range, even if reheat quenching is performed in the next step [2], sufficient refinement of prior-austenite grains cannot be realized in some cases.

The step [1] need not necessarily be restricted specifically except that the heating is performed at a temperature exceeding the $Ac_1$ transformation point and lower than the $Ac_3$ transformation point, that is, at a temperature in the two-phase region of ferrite and austenite.

Even if the heating treatment is performed under the condition that the value of PL expressed by $$PL=(T+273)\times(20+\log_{10} t)$$

in which T is heating temperature (° C.) and t is heating time (h), exceeds 23,500, the refinement of austenite grains quenched in the next step [2] tends to saturate, and the cost merely increases. Therefore, the heating treatment is preferably performed under the condition that the value of PL is 23,500 or smaller. Concerning the heating time, depending on the furnace type used for heating, at least 10 s is desirable. Also, the cooling after the heating treatment is preferably air cooling.

After step [1], the steel is subjected to a step of being reheated to a temperature not lower than the $Ac_3$ transformation point in step [2], that is, to a temperature in the austenite temperature range and being quenched by rapid cooling, whereby the refinement of austenite grains is achieved.

If the reheating temperature in step [2] exceeds ($Ac_3$ transformation point+100° C.), the prior-austenite grains are sometimes coarsened. Therefore, the reheating temperature in step [2] is preferably ($Ac_3$ transformation point+100° C.) or lower.

The quenching method need not necessarily be subject to any specific restriction. A water quenching method is used generally, however, as long as martensitic transformation occurs in the quenching treatment, the steel may be rapidly cooled by an appropriate method such as a mist quenching method.

After step [2], the steel is subjected to a step of being tempered at a temperature not higher than the $Ac_1$ transformation point in step [3], that is, at a temperature in the temperature range in which reverse transformation into austenite does not occur, whereby the high-strength steel material excellent in sulfide stress cracking resistance can be obtained. The lower limit of the tempering temperature may be determined appropriately by the chemical composition of steel and the strength required for the steel material. For example, the tempering may be performed at a higher temperature to decrease the strength, and on the other hand, at a lower temperature to increase the strength. As the cooling method after tempering, air cooling is desirable.

Hereunder, the method for producing a steel material in accordance with the present invention is explained in more detail by taking the case where a seamless steel pipe is manufactured as an example.

In the case where the high-strength steel material excellent in sulfide stress cracking resistance is a seamless steel pipe, a billet having the chemical composition described in item (A) is prepared.

The billet may be bloomed from a steel block such as a bloom or a slab, or may be cast by round CC. Needless to say, the billet may also be formed from an ingot.

From the billet, a pipe is hot-rolled. In particular, first, the billet is heated to a temperature in the temperature range in which piercing can be performed, and is subjected to hot piercing process. The billet heating temperature before piercing is usually in the range of 1100 to 1300° C.

The means for hot piercing is not necessarily restricted. For example, a hollow shell can be obtained by the Mannesmann piercing process or the like.

The obtained hollow shell is subjected to elongation working and finish working.

The elongation working is a step for manufacturing a seamless steel pipe having a desired shape and size by elongating the hollow shell having been pierced by a piercing machine and regulating the size. This step can be performed by using, for example, a mandrel mill or a plug mill. Also, the finish working can be performed by using a sizer or the like.

The working ratio of elongation working and finish working is not necessarily restricted. The finishing temperature in the finish working is preferably 1100° C. or lower. However, if the finishing temperature exceeds 1050° C., a tendency for coarsening of crystal grains is sometimes developed. Therefore, the finishing temperature in the finish working is further preferably 1050° C. or lower. At a temperature not higher than 900° C., working is difficult to do on account of the increase in deformation resistance, so that the pipe-making is preferably performed at a temperature exceeding 900° C.

As shown in the present invention (3), the seamless steel pipe having been subjected to hot finish working may be air-cooled as it is. The "air cooling" described herein includes so-called "natural cooling" or "being allowed to cool".

Additionally, as shown in the present invention (4), the seamless steel pipe having been subjected to hot finish working may be supplementarily heated at a temperature not lower than the $Ar_3$ transformation point and not higher than 1050° C. in line, and quenched from a temperature not lower than the $Ar_3$ transformation point, that is, at a temperature in the austenite temperature range. In this case, since two quenching treatment including the reheat quenching treatment is performed in the subsequent step [2], the refinement of crystal grains can be realized.

If the seamless steel pipe is supplementarily heated at a temperature exceeding 1050° C., the coarsening of austenite grains becomes remarkable, and even if reheat quenching treatment is performed in the subsequent step [2], the refinement of prior-austenite grains becomes difficult to do in some cases. The upper limit of the supplemental heating temperature is preferably 1000° C. As the method for quenching from a temperature not lower than the $Ar_3$ transformation point, a general water quenching method is economical, however, any quenching method in which martensitic transformation occurs can be used, and, for example, a mist quenching method may be used.

Moreover, as shown in the present invention (5), the seamless steel pipe having been subjected to hot finish working may be directly quenched from a temperature not lower than the $Ar_3$ transformation point, that is, from a temperature in the austenite temperature range. In this case, since two quenching treatment including the reheat quenching treatment is performed in the subsequent step [2], the refinement of crystal grains can be realized. As the method for quenching from a temperature not lower than the $Ar_3$ transformation point, a general water quenching method is economical, however, any quenching method in which martensitic transformation occurs can be used, and, for example, a mist quenching method may be used.

In the above-described methods, the seamless steel pipe having finished being hot-worked and subsequently cooled is subjected to "the step of heating the steel to a temperature exceeding the $Ac_1$ transformation point and lower than the $Ac_3$ transformation point and cooling the steel" in step [1], which is a characteristic step of the present invention.

In the explanation below, the heating performed before step [2], that is, the heating in step [1] is sometimes referred to as "intermediate heat treatment".

The intermediate heat treatment is preferably performed by a heating apparatus connected to an apparatus for quenching of inline heat treatment when the seamless steel pipe having been subjected to hot finish working is supplementarily heated at a temperature not lower than the $Ar_3$ transformation point and not higher than 1050° C. in line, quenched from a temperature not lower than the $Ar_3$ transformation point, and subsequently subjected to the intermediate heat treatment, as shown in the present invention (6). Besides, the intermediate heat treatment is preferably performed by a heating apparatus connected to a quenching apparatus that performs direct quenching when the seamless steel pipe having been subjected to hot finish working is directly quenched from a temperature not lower than the $Ar_3$ transformation point, and subsequently subjected to the intermediate heat treatment, as shown in the present invention (7). By using the heating apparatuses, a sufficient effect of restraining season cracking is achieved.

As already described, the heating conditions in step [1] need not necessarily be restricted specifically except that the heating is performed at a temperature exceeding the $Ac_1$ transformation point and lower than the $Ac_3$ transformation point, that is, at a temperature in the two-phase region of ferrite and austenite.

The seamless steel pipe having been subjected to step [1] is reheated and quenched in step [2], and further is tempered in step [3].

By the above-described methods, there can be obtained a high-strength seamless steel pipe which is excellent in SSC resistance, and by which the improvement in toughness can also be expected.

Hereunder, the present invention is explained more specifically by reference to examples. The present invention is not limited to the examples.

EXAMPLES

Example 1

The components of each of steels A to L having the chemical compositions given in Table 1 were regulated in a converter, and each of the steels A to L was subjected to continuous casting, whereby a billet having a diameter of 310 mm was prepared. Table 1 additionally gives the $Ac_1$ transformation point and $Ac_3$ transformation point that were calculated by using the Andrews formulas [1] and [2] (K. W. Andrews: JISI, 203 (1965), pp. 721-727) described below. For each steel, Cu, W and As were not detected in a concentration of such a degree as to exert an influence on the calculated value.

$$Ac_1\ \text{point}(^\circ\ \text{C.}) = 723 + 29.1\times Si - 10.7\times Mn - 16.9\times Ni + 16.9\times Cr + 6.38\times W + 290\times As \quad [1]$$

$$Ac_3\ \text{point}(^\circ\ \text{C.}) = 910 - 203\times C^{0.5} + 44.7\times Si - 15.2\times Ni + 31.5\times Mo + 104\times V + 13.1\times W - (30\times Mn + 11\times Cr + 20\times Cu - 700\times P - 400\times Al - 120\times As - 400\times Ti) \quad [2]$$

where, each of C, Si, Mn, Cu, Ni, Cr, Mo, V, Ti, Al, W, As and P in the formulas means the content by mass percent of that element.

TABLE 1

| | Chemical composition (in mass %, balance: Fe and impurities) | | | | | | | | | |
|---|---|---|---|---|---|---|---|---|---|---|
| Steel | C | Si | Mn | P | S | Ni | Cr | Mo | Ti | Al |
| A | 0.26 | 0.28 | 0.46 | 0.011 | 0.0005 | 0.03 | 1.03 | 0.70 | 0.013 | 0.026 |
| B | 0.26 | 0.31 | 0.43 | 0.007 | 0.0005 | 0.03 | 1.06 | 0.68 | 0.014 | 0.040 |
| C | 0.27 | 0.29 | 0.47 | 0.007 | 0.0005 | 0.03 | 1.04 | 0.71 | 0.014 | 0.040 |
| D | 0.26 | 0.29 | 0.43 | 0.009 | 0.0028 | 0.03 | 1.05 | 0.69 | 0.018 | 0.037 |
| E | 0.26 | 0.24 | 0.44 | 0.009 | 0.0047 | 0.03 | 1.02 | 0.45 | 0.026 | 0.036 |
| F | 0.27 | 0.35 | 0.43 | 0.012 | 0.0008 | 0.01 | 0.63 | 0.32 | 0.013 | 0.048 |
| G | 0.35 | 0.26 | 0.43 | 0.011 | 0.0010 | 0.01 | 1.01 | 0.69 | 0.016 | 0.035 |
| H | 0.40 | 0.26 | 0.43 | 0.011 | 0.0009 | 0.01 | 1.00 | 0.70 | 0.016 | 0.034 |
| I | 0.39 | 0.27 | 0.41 | 0.014 | 0.0006 | 0.01 | 0.21 | 1.96 | 0.015 | 0.021 |
| J | 0.48 | 0.31 | 0.47 | 0.012 | 0.0014 | 0.01 | 1.06 | 0.67 | 0.010 | 0.029 |
| K | 0.64 | 0.24 | 0.40 | 0.009 | 0.0009 | 0.01 | 1.00 | 0.71 | 0.010 | 0.028 |
| L | 0.27 | 0.30 | 0.35 | 0.008 | 0.0012 | 0.01 | 0.85 | 0.95 | 0.007 | 0.035 |

| | Chemical composition (in mass %, balance: Fe and impurities) | | | | | | | $Ac_1$ | $Ac_3$ |
|---|---|---|---|---|---|---|---|---|---|
| Steel | N | O | V | Nb | B | Ca | Mg | (° C.) | (° C.) |
| A | 0.0043 | 0.0013 | 0.09 | 0.013 | 0.0011 | 0.0014 | — | 743 | 848 |
| B | 0.0038 | 0.0006 | 0.09 | 0.028 | 0.0011 | — | — | 745 | 852 |
| C | 0.0035 | 0.0012 | 0.09 | 0.014 | — | 0.0013 | — | 743 | 850 |
| D | 0.0031 | 0.0006 | — | 0.028 | 0.0012 | 0.0012 | — | 744 | 845 |
| E | 0.0042 | 0.0010 | — | 0.027 | 0.0012 | 0.0010 | — | 742 | 838 |
| F | 0.0035 | 0.0012 | 0.05 | — | 0.0010 | 0.0023 | — | 739 | 848 |
| G | 0.0036 | 0.0013 | 0.10 | 0.015 | — | 0.0015 | — | 743 | 837 |
| H | 0.0027 | 0.0011 | 0.10 | 0.029 | 0.0010 | 0.0016 | 0.0005 | 743 | 829 |
| I | 0.0032 | 0.0015 | 0.10 | 0.029 | 0.0011 | 0.0021 | — | 730 | 877 |
| J | 0.0034 | 0.0008 | 0.10 | 0.012 | — | 0.0018 | — | 745 | 813 |
| K | 0.0033 | 0.0009 | 0.10 | 0.014 | — | 0.0023 | — | 742 | 789 |
| L | 0.0035 | 0.0012 | — | — | — | — | — | 758 | 828 |

The billet was heated to 1250° C., and thereafter was hot-worked and finished into a seamless steel pipe having a desired shape. In particular, the billet having been heated to 1250° C. was first pierced by using a Mannesmann piercing mill to obtain a hollow shell. Then, the hollow shell was subjected to elongation working by using a mandrel mill and finish working by using a stretch reducing mill, and was finished into a seamless steel pipe having an outside diameter of 244.48 mm, a wall thickness of 13.84 mm, and a length of 12 m. The finishing temperature in the diameter-reducing working using the stretch reducing mill was about 950° C. in all cases.

The seamless steel pipe having been finished so as to have the above-described dimensions was cooled under the conditions given in Table 2.

The "ILQ" in Table 2 indicates that the finished seamless steel pipe was supplementarily heated under the conditions of 950° C.×10 min in line, and was quenched by water cooling. The "DQ" indicates that the finished seamless steel pipe was water-cooled from a temperature not lower than 900° C., which is a temperature not lower than the $Ar_3$ transformation point, without being supplementarily heated, and was directly quenched. The "AR" indicates that the finished seamless steel pipe was air-cooled to room temperature.

The seamless steel pipe thus obtained was cut in pieces, and was subjected to intermediate heat treatment experimentally under the conditions given in Table 2. The cooling after the intermediate heat treatment was air cooling. The symbol "-" in the intermediate heat treatment column of Table 2 indicates that the intermediate heat treatment was not performed.

From the steel pipe having been air-cooled after intermediate heat treatment, a test specimen for measuring hardness was cut out, and the Rockwell C hardness (hereinafter, abbreviated as "HRC") was measured. The measurement of HRC was made from the viewpoint of evaluation of season cracking resistance. If the HRC is 41 or less, especially 40 or less, it can be judged that the occurrence of season cracking can be suppressed. For the seamless steel pipe of "AR", that is, the steel pipe that was air-cooled to room temperature after being finished, season cracking will not occur because the steel pipe was not quenched. Therefore, for the steel pipe subjected to intermediate heat treatment as well, the measurement of HRC was omitted.

Next, the steel pipe having been air-cooled after the intermediate heat treatment was subjected to reheat quenching experimentally in step [2], in which the steel pipe was heated at 920° C. for 20 minutes and was quenched. Concerning the reheat quenching, for the steel pipes using steels A to F and L, the steel pipe was quenched by being dipped in tank or was rapidly cooled by using jet water, and for the steel pipes using steels G to K, the steel pipe was cooled by mist water spraying.

After the reheat quenching, the prior-austenite grain size number was examined. That is, a test specimen was cut out of the reheat-quenched steel pipe so that the cross section thereof perpendicular to the length direction of pipe (pipe-making direction) is a surface to be examined, and was embedded in a resin. Thereby, the prior-austenite grain boundary was revealed by the Bechet-Beaujard method, in which the test specimen was corroded by picric acid saturated aqueous solution, and the prior-austenite grain size number was examined in conformity to ASTM E112-10.

Table 2 additionally gives the HRC in the case where the steel pipe was air-cooled after the intermediate heat treatment and the measurement result of prior-austenite grain size number after reheat quenching. In Table 2, for ease of description, the above-described HRC was described as "HRC after intermediate heat treatment".

TABLE 2

| | | | Intermediate heat treatment | | | | the prior-austenite | |
|---|---|---|---|---|---|---|---|---|
| Test No. | Steel | Cooling condition | Heating temperature (° C.) | Heating time (min) | PL value | HRC after intermediate heat treatment | grain size number after reheat quenching | |
| 1 | A | ILQ | 760 | 60 | 20660 | 20.3 | 10.0 | Inventive |
| 2 | A | ILQ | 780 | 60 | 21060 | 24.4 | 10.6 | example |
| 3 | A | ILQ | 800 | 30 | 21137 | 24.7 | 10.1 | |
| 4 | A | ILQ | 720 * | 30 | 19561 | 30.0 | 8.4 | Comparative |
| 5 | A | ILQ | 740 * | 30 | 19955 | 26.1 | 8.5 | example |
| 6 | A | AR | - * | - | - | -- | 8.4 | |
| 7 | B | ILQ | 780 | 30 | 20743 | 24.5 | 10.3 | Inventive |
| 8 | B | DQ | 780 | 30 | 20743 | 25.2 | 10.4 | example |
| 9 | B | AR | 780 | 60 | 20660 | -- | 10.4 | |
| 10 | B | IL | 550 * | 30 | 16212 | 40.8 | 8.8 | Comparative |
| 11 | B | DQ | 550 * | 30 | 16212 | 40.7 | 9.1 | example |
| 12 | B | AR | - * | - | - | -- | 8.3 | |
| 13 | C | ILQ | 760 | 180 | 21153 | 20.0 | 10.4 | Inventive |
| 14 | C | ILQ | 780 | 30 | 20743 | 24.6 | 10.3 | example |
| 15 | C | ILQ | 780 | 180 | 21562 | 23.8 | 10.4 | |
| 16 | C | ILQ | 800 | 180 | 21972 | 23.4 | 10.3 | |
| 17 | C | ILQ | 830 | 120 | 22392 | 28.5 | 10.0 | |
| 18 | C | ILQ | 740 * | 30 | 19955 | 22.4 | 8.4 | Comp. ex. |
| 19 | D | ILQ | 760 | 30 | 20349 | 18.3 | 10.0 | Inventive |
| 20 | D | ILQ | 760 | 180 | 21153 | 17.2 | 10.2 | example |
| 21 | D | ILQ | 780 | 30 | 20743 | 22.4 | 10.5 | |
| 22 | D | ILQ | 780 | 180 | 21562 | 24.1 | 10.3 | |
| 23 | D | ILQ | 830 | 90 | 22254 | 30.3 | 10.0 | |
| 24 | D | DQ | 780 | 30 | 20743 | 22.2 | 10.4 | |
| 25 | D | ILQ | 650 * | 30 | 18182 | 39.1 | 8.8 | Comp. ex. |
| 26 | E | ILQ | 760 | 30 | 20349 | 16.6 | 10.0 | Inventive |
| 27 | E | ILQ | 760 | 60 | 20660 | 16.3 | 10.1 | example |
| 28 | E | ILQ | 760 | 180 | 21153 | 15.3 | 10.5 | |
| 29 | E | ILQ | 780 | 180 | 21562 | 19.5 | 10.5 | |
| 30 | E | DQ | 780 | 30 | 20743 | 17.1 | 10.3 | |
| 31 | E | DQ | 710 * | 180 | 20129 | 21.8 | 8.3 | Comparative |
| 32 | E | ILQ | 710 * | 300 | 20347 | 20.1 | 8.3 | example |
| 33 | F | ILQ | 770 | 50 | 20777 | 17.0 | 9.7 | Inventive |
| 34 | F | AR | 770 | 50 | 20777 | 17.2 | 9.6 | example |
| 35 | F | ILQ | 600 | 30 | 17197 | 30.4 | 8.3 | Comp. ex. |
| 36 | G | ILQ | 760 | 60 | 20660 | 20.0 | 10.1 | Inventive |
| 37 | G | ILQ | 760 | 180 | 21153 | 20.5 | 10.5 | example |

TABLE 2-continued

| Test No. | Steel | Cooling condition | Intermediate heat treatment: Heating temperature (° C.) | Intermediate heat treatment: Heating time (min) | Intermediate heat treatment: PL value | HRC after intermediate heat treatment | the prior-austenite grain size number after reheat quenching |
|---|---|---|---|---|---|---|---|
| 38 | G | ILQ | 780 | 180 | 21562 | 21.1 | 10.5 |
| 39 | G | DQ | 800 | 30 | 21137 | 24.3 | 10.3 |
| 40 | H | AR | 760 | 60 | 20660 | 19.5 | 10.2 |
| 41 | H | AR | 760 | 180 | 21153 | 19.2 | 10.5 |
| 42 | H | AR | 780 | 30 | 20743 | 20.4 | 10.5 |
| 43 | I | AR | 760 | 60 | 20660 | 22.5 | 10.8 |
| 44 | I | AR | 780 | 30 | 20743 | 23.8 | 10.8 |
| 45 | J | AR | 780 | 30 | 20743 | 25.5 | 11.1 |
| 46 | K | AR | 780 | 30 | 20743 | 26.5 | 11.2 |
| 47 | L | AR | 810 | 60 | 21660 | 24.0 | 9.5 |

$PL = (T + 273) \times (20 + \log_{10}t)$

[where T is heating temperature (° C.) and t is heating time (h)]

"-" in the intermediate heat treatment column indicates that the intermediate heat treatment was not performed.

"--" in column of HRC after intermediate heat treatment indicates that HRC measurement was not performed.

* indicates that conditions do not satisfy those defined by the present invention.

Table 2 clearly demonstrates that regardless of the cooling conditions of seamless steel pipe, in the test numbers of example embodiments of the present invention in which the steel pipe was cooled after being heated at a temperature exceeding the $Ac_1$ transformation point and lower than the $Ac_3$ transformation point as defined in the present invention, that is, at a temperature in the two-phase region of ferrite and austenite, the prior-austenite grain size number after reheat quenching was 9.5 in test number 47 even in the case of the coarsest grains, and in most cases, was 10 or more, indicating fine grains.

While the prior-austenite grain size numbers of test numbers 9, 34, and 40 to 47 of example embodiments of the present invention were 9.5 to 11.2, the prior-austenite grain size numbers of test numbers 6 and 12 of comparative examples were 8.4 and 8.3, respectively. It is apparent that even in the case where the seamless steel pipe is air-cooled and is not quenched after finish working, if the steel pipe is manufactured by the method in accordance with the present invention, an excellent refinement effect can be achieved.

Moreover, in example embodiments of the present invention, the HRC in the case where the steel pipe was air-cooled after intermediate heat treatment was 30.3 or less, so that season cracking will not occur.

In contrast, in test numbers of comparative examples in which the steel pipe was cooled after being heated at a temperature not higher than the $Ac_1$ transformation point deviating from the condition defined in the present invention, the prior-austenite grain size numbers after reheat quenching were at most 9.1 (test number 11), and the grains were coarse as compared with example embodiments of the present invention.

As described above, it is apparent that by subjecting the steel, which has the chemical composition defined in the present invention and has been hot-worked into a desired shape, to the steps [1] and [2] defined in the present invention sequentially, that is, by cooling the steel having been heated at a temperature exceeding the $Ac_1$ transformation point and lower than the $Ac_3$ transformation point and then by reheating the steel to a temperature not lower than the $Ac_3$ transformation point and quenching it by rapid cooling, the prior-austenite grains can be made fine. By the refinement of prior-austenite grains, the improvement in SSC resistance and toughness can be expected.

Example 2

To confirm the improvement in SSC resistance due to the refinement of prior-austenite grains, which improvement was achieved by the method of the present invention, some of the steel pipes subjected to the reheat quenching described above (example 1) were subjected to tempering in step [3]. The tempering was performed by heating the steel pipe at a temperature of 650 to 710° C. for 30 to 60 minutes so that the YS is set to about 655 to 862 MPa (95 to 125 ksi), and the cooling after the tempering was air cooling.

Table 3 gives the specific tempering conditions together with the cooling conditions after the finish working of seamless steel pipe and the prior-austenite grain size number after reheat quenching. The test numbers in Table 3 correspond to the test numbers in Table 2 described above (example 1). Also, a to d affixed to test numbers 7 and 8 are marks meaning that the tempering conditions were changed.

From each of the tempered steel pipes, a test specimen for measuring hardness was cut out to measure the HRC.

Also, from the steel pipe, a round-bar tensile test specimen specified in NACE TM0177 Method A, which test specimen has a parallel part having an outside diameter of 6.35 mm and a length of 25.4 mm, was cut out so that the longitudinal direction thereof is the length direction of steel pipe (pipe-making direction), and the tensile properties at room temperature were examined. Based on the result of this examination, the constant load test specified in NACE TM0177 Method A was conducted to examine the SSC resistance.

As the test solution for the SSC resistance examination, an aqueous solution of 0.5% acetic acid+5% sodium chloride was used. While hydrogen sulfide gas of 0.1 MPa was fed into this solution, a stress of 90% of the actually measured YS (hereinafter, referred to as a "90% AYS") or a stress of 85% of the nominal lower-limit YS (hereinafter, referred to as a "85% SMYS") was imposed, whereby the constant load test was conducted.

Specifically, in test numbers 1 to 5, 14, 21, 23, 26, 38, 42, and 44 to 47 given in Table 3, the constant load test was conducted by imposing the 90% AYS. Also, in test numbers 7a to 12 and 33 to 35, the constant load test was conducted by imposing 645 MPa as the 85% SMYS considering the strength level as 110 ksi class in which the YS is 758 to 862 MPa (110 to 125 ksi) from the examination result of tensile properties. In each of test numbers, the SSC resistance was evaluated by the shortest rupture time by making the number of tests 2 or 3. When rupture did not occur at the test of 720 hours, the constant load test was discontinued at that time.

Table 3 additionally gives the examination results of HRC, tensile properties, and SSC resistance. The shortest rupture time ">720" in the SSC resistance column of Table 3 indicates that all of the test specimens were not ruptured at the test of 720 hours. In the above-described case, in Table 3, "○" mark was described in the judgment column considering the SSC resistance as being excellent. On the other hand, in the case where the rupture time is not longer than 720 hours, "x" mark was described in the judgment column considering the SSC resistance as being poor.

TABLE 3

| Test No. | Steel | Cooling condition | the prior-austenite grain size number after reheat quenching | Tempering Heating temperature (° C.) | Tempering Heating time (min) | HRC | Tensile properties YS (MPa) | Tensile properties TS (MPa) | Tensile properties YR (%) | SSC resistance Load stress | SSC resistance Shortest rupture time (h) | SSC resistance judgment | |
|---|---|---|---|---|---|---|---|---|---|---|---|---|---|
| 1 | A | ILQ | 10.0 | 705 | 45 | 27.1 | 800 | 884 | 90.5 | 90% AYS | >720 | ○ | Inventive |
| 2 | A | ILQ | 10.6 | 705 | 45 | 27.1 | 802 | 879 | 91.2 | 90% AYS | >720 | ○ | example |
| 3 | A | ILQ | 10.1 | 705 | 45 | 28.4 | 824 | 904 | 91.2 | 90% AYS | >720 | ○ | |
| 4 * | A | ILQ | 8.4 | 705 | 45 | 27.2 | 777 | 878 | 88.5 | 90% AYS | 286.3 | x | Comparative |
| 5 * | A | ILQ | 8.5 | 705 | 45 | 26.9 | 779 | 873 | 89.2 | 90% AYS | 330 | x | example |
| 7a | B | ILQ | 10.3 | 710 | 30 | 27.4 | 792 | 867 | 91.4 | 85% SMYS | >720 | ○ | Inventive |
| 7b | B | ILQ | 10.3 | 700 | 45 | 27.3 | 838 | 921 | 90.9 | 85% SMYS | >720 | ○ | example |
| 7c | B | ILQ | 10.3 | 700 | 45 | 28.7 | 841 | 916 | 91.8 | 85% SMYS | >720 | ○ | |
| 7d | B | ILQ | 10.3 | 700 | 30 | 29.3 | 863 | 934 | 92.3 | 85% SMYS | >720 | ○ | |
| 8a | B | DQ | 10.4 | 705 | 60 | 27.6 | 783 | 853 | 91.8 | 85% SMYS | >720 | ○ | |
| 8b | B | DQ | 10.4 | 705 | 30 | 27.7 | 811 | 887 | 91.4 | 85% SMYS | >720 | ○ | |
| 8c | B | DQ | 10.4 | 700 | 45 | 29.7 | 835 | 911 | 91.7 | 85% SMYS | >720 | ○ | |
| 9 | B | AR | 10.4 | 705 | 30 | 27.6 | 801 | 885 | 90.6 | 85% SMYS | >720 | ○ | |
| 10 * | B | IL | 8.8 | 710 | 30 | 28.3 | 804 | 893 | 90.0 | 85% SMYS | 231 | x | Comparative |
| 11 * | B | DQ | 9.1 | 705 | 30 | 29.9 | 814 | 904 | 90.1 | 85% SMYS | 368 | x | example |
| 12 * | B | AR | 8.3 | 710 | 30 | 26.8 | 798 | 895 | 89.1 | 85% SMYS | 479.6 | x | |
| 14 | C | ILQ | 10.3 | 705 | 60 | 27.0 | 782 | 861 | 90.8 | 90% AYS | >720 | ○ | Inventive |
| 21 | D | ILQ | 10.5 | 705 | 30 | 23.5 | 723 | 829 | 87.2 | 90% AYS | >720 | ○ | example |
| 23 | D | ILQ | 10.0 | 705 | 30 | 24.1 | 737 | 828 | 89.0 | 90% AYS | >720 | ○ | |
| 26 | E | ILQ | 10.0 | 695 | 30 | 25.0 | 729 | 832 | 87.6 | 90% AYS | >720 | ○ | |
| 33 | F | ILQ | 9.7 | 680 | 60 | 26.3 | 793 | 862 | 92.0 | 85% SMYS | >720 | ○ | |
| 34 | F | AR | 9.6 | 685 | 45 | 25.8 | 789 | 865 | 91.2 | 85% SMYS | >720 | ○ | |
| 35 * | F | ILQ | 8.3 | 650 | 30 | 27.0 | 810 | 912 | 88.8 | 85% SMYS | 205 | x | Comp. ex. |
| 38 | G | ILQ | 10.5 | 700 | 60 | 28.5 | 826 | 907 | 91.1 | 90% AYS | >720 | ○ | Inventive |
| 42 | H | AR | 10.5 | 705 | 60 | 29.1 | 839 | 932 | 90.0 | 90% AYS | >720 | ○ | example |
| 44 | I | AR | 10.8 | 690 | 60 | 29.9 | 897 | 933 | 96.1 | 90% AYS | >720 | ○ | |
| 45 | J | AR | 11.1 | 710 | 60 | 29.7 | 863 | 939 | 92.0 | 90% AYS | >720 | ○ | |
| 46 | K | AR | 11.2 | 705 | 60 | 30.5 | 887 | 943 | 94.1 | 90% AYS | >720 | ○ | |
| 47 | L | AR | 9.5 | 700 | 60 | 23.0 | 703 | 790 | 89.0 | 90% AYS | >720 | ○ | |

">720" in the SSC resistance column indicates that all of the test specimens were not ruptured at the test of 720 hours.

"○" was described in the judgment column considering the SSC resistance as being excellent. On the other hand, in the case where the rupture time is not longer than 720 hours, "x" mark was described in the judgment column considering the SSC resistance as being poor.

* indicates that conditions do not satisfy those defined by the present invention.

Table 3 evidently shows that by subjecting the steel, in which the refinement of prior-austenite grains is achieved by the sequential performance of steps [1] and [2] defined in the present invention, to tempering treatment in step [3], an excellent SSC resistance can be attained.

INDUSTRIAL APPLICABILITY

According to the present invention, since the refinement of prior-austenite grains can be realized by an economically efficient means, a high-strength steel material excellent in SSC resistance can be obtained at a low cost. Also, by the present invention, a high-strength low-alloy steel seamless oil-well pipe excellent in SSC resistance can be produced at a relatively low cost. Further, according to the present invention, the improvement in toughness due to the refinement of prior-austenite grains can be expected.

What is claimed is:

1. A method for producing a high-strength steel material excellent in sulfide stress cracking resistance, wherein a steel that has a chemical composition consisting of, by mass percent, C: 0.15 to 0.65%, Si: 0.05 to 0.5%, Mn: 0.1 to 1.5%, Cr: 0.2 to 1.5%, Mo: 0.1 to 2.5%, Ti: 0.005 to 0.50%, Al: 0.001 to 0.50%, and the balance of Fe and impurities, wherein Ni, P, S, N and O among the impurities are Ni: 0.1% or less, P: 0.04% or less, S: 0.01% or less, N: 0.01% or less, and O: 0.01% or less, and that has been hot-worked into a desired shape is sequentially subjected to the steps of the following [1] to [3]:

[1] a step of heating the steel to a temperature exceeding the $Ac_1$ transformation point and lower than the $Ac_3$ transformation point and cooling the steel;

[2] a step of reheating the steel to a temperature not lower than the $Ac_3$ transformation point and quenching the steel by rapid cooling; and

[3] a step of tempering the steel at a temperature not higher than the $Ac_1$ transformation point.

2. A method for producing a high-strength steel material excellent in sulfide stress cracking resistance, wherein a steel that has a chemical composition consisting of, by mass percent, C: 0.15 to 0.65%, Si: 0.05 to 0.5%, Mn: 0.1 to 1.5%, Cr: 0.2 to 1.5%, Mo: 0.1 to 2.5%, Ti: 0.005 to 0.50%, Al: 0.001 to 0.50%, at least one selected from the elements shown in (a) and (b), and the balance of Fe and impurities, wherein Ni, P, 5, N and O among the impurities are Ni: 0.1% or less, P: 0.04% or less, S: 0.01% or less, N: 0.01% or less, and O: 0.01% or less, and that has been hot-worked into a desired shape is sequentially subjected to the steps of the following [1] to [3]:

[1] a step of heating the steel to a temperature exceeding the $Ac_1$ transformation point and lower than the $Ac_3$ transformation point and cooling the steel;

[2] a step of reheating the steel to a temperature not lower than the $Ac_3$ transformation point and quenching the steel by rapid cooling; and

[3] a step of tempering the steel at a temperature not higher than the $Ac_1$ transformation point;

(a) Nb: 0.4% or less, V: 0.5% or less, and B: 0.01% or less;

(b) Ca: 0.005% or less, Mg: 0.005% or less, and REM: 0.005% or less.

3. The method for producing a high-strength steel material excellent in sulfide stress cracking resistance according to claim 1, wherein the steel having a chemical composition consisting of, by mass percent, C: 0.15 to 0.65%, Si: 0.05 to 0.5%, Mn: 0.1 to 1.5%, Cr: 0.2 to 1.5%, Mo: 0.1 to 2.5%, Ti: 0.005 to 0.50%, Al: 0.001 to 0.50%, and the balance of Fe and impurities, wherein Ni, P, S, N and O among the impurities are Ni: 0.1% or less, P: 0.04% or less, S: 0.01% or less, N: 0.01% or less, and O: 0.01% or less, is hot-finished into a seamless steel pipe and is air cooled, and thereafter is sequentially subjected to the steps of [1] to [3].

4. The method for producing a high-strength steel material excellent in sulfide stress cracking resistance according to claim 1, wherein after the steel having the chemical composition consisting of, by mass percent, C: 0.15 to 0.65%, Si: 0.05 to 0.5%, Mn: 0.1 to 1.5%, Cr: 0.2 to 1.5%, Mo: 0.1 to 2.5%, Ti: 0.005 to 0.50%, Al: 0.001 to 0.50%, and the balance of Fe and impurities, wherein Ni, P, S, N and O among the impurities are Ni: 0.1% or less, P: 0.04% or less, S: 0.01% or less, N: 0.01% or less, and O: 0.01% or less, has been hot-finished into a seamless steel pipe, the steel is supplementarily heated at a temperature not lower than the $Ar_3$ transformation point and not higher than 1050° C. in line, and after being quenched from a temperature not lower than the $Ar_3$ transformation point, the steel is sequentially subjected to the steps of [1] to [3].

5. The method for producing a high-strength steel material excellent in sulfide stress cracking resistance according to claim 1, wherein after the steel having the chemical composition consisting of, by mass percent, C: 0.15 to 0.65%, Si: 0.05 to 0.5%, Mn: 0.1 to 1.5%, Cr: 0.2 to 1.5%, Mo: 0.1 to 2.5%, Ti: 0.005 to 0.50%, Al: 0.001 to 0.50%, and the balance of Fe and impurities, wherein Ni, P, S, N and O among the impurities are Ni: 0.1% or less, P: 0.04% or less, S: 0.01% or less, N: 0.01% or less, and O: 0.01% or less, has been hot-finished into a seamless steel pipe, the steel is directly quenched from a temperature not lower than the Ara transformation point, and thereafter is sequentially subjected to the steps of [1] to [3].

6. The method for producing a high-strength steel material excellent in sulfide stress cracking resistance according to claim 4, wherein the heating in step [1] is performed by a heating apparatus connected to an apparatus for quenching of inline heat treatment.

7. The method for producing a high-strength steel material excellent in sulfide stress cracking resistance according to claim 5, wherein the heating in step [1] is performed by a heating apparatus connected to a quenching apparatus that performs direct quenching.

8. The method for producing a high-strength steel material excellent in sulfide stress cracking resistance according to claim 2, wherein the steel has a chemical composition consisting of, by mass percent, C: 0.15 to 0.65%, Si: 0.05 to 0.5%, Mn: 0.1 to 1.5%, Cr: 0.2 to 1.5%, Mo: 0.1 to 2.5%, Ti: 0.005 to 0.50%, Al: 0.001 to 0.50%, at least one selected from the elements shown in (a) and (b), and the balance of Fe and impurities, wherein Ni, P, S, N and O among the impurities are Ni: 0.1% or less, P: 0.04% or less, S: 0.01% or less, N: 0.01% or less, and O: 0.01% or less, (a) Nb: 0.4% or less, V: 0.5% or less, and B: 0.01% or less;

(b) Ca: 0.005% or less, Mg: 0.005% or less, and REM: 0.005% or less, is hot-finished into a seamless steel pipe and is air cooled, and thereafter is sequentially subjected to the steps of [1] to [3].

9. The method for producing a high-strength steel material excellent in sulfide stress cracking resistance according to claim 2, wherein after the steel having the chemical composition consisting of, by mass percent, C: 0.15 to 0.65%, Si: 0.05 to 0.5%, Mn: 0.1 to 1.5%, Cr: 0.2 to 1.5%, Mo: 0.1 to 2.5%, Ti: 0.005 to 0.50%, Al: 0.001 to 0.50%, at least one selected from the elements shown in (a) and (b), and the balance of Fe and impurities, wherein Ni, P, S, N and O among the impurities are Ni: 0.1% or less, P: 0.04% or less, S: 0.01% or less, N: 0.01% or less, and O: 0.01% or less, (a) Nb: 0.4% or less, V: 0.5% or less, and B: 0.01% or less;

(b) Ca: 0.005% or less, Mg: 0.005% or less, and REM: 0.005% or less, has been hot-finished into a seamless steel pipe, the steel is supplementarily heated at a temperature not lower than the $Ar_3$ transformation point and not higher than 1050° C. in line, and after being quenched from a temperature not lower than the $Ar_3$ transformation point, the steel is sequentially subjected to the steps of [1] to [3].

10. The method for producing a high-strength steel material excellent in sulfide stress cracking resistance according to claim 2, wherein after the steel having the chemical composition consisting of, by mass percent, C: 0.15 to 0.65%, Si: 0.05 to 0.5%, Mn: 0.1 to 1.5%, Cr: 0.2 to 1.5%, Mo: 0.1 to 2.5%, Ti: 0.005 to 0.50%, Al: 0.001 to 0.50%, at least one selected from the elements shown in (a) and (b), and the balance of Fe and impurities, wherein Ni, P, S, N and O among the impurities are Ni: 0.1% or less, P: 0.04% or less, S: 0.01% or less, N: 0.01% or less, and O: 0.01% or less, (a) Nb: 0.4% or less, V: 0.5% or less, and B: 0.01% or less;

(b) Ca: 0.005% or less, Mg: 0.005% or less, and REM: 0.005% or less, has been hot-finished into a seamless steel pipe, the steel is directly quenched from a temperature not lower than the $Ar_3$ transformation point, and thereafter is sequentially subjected to the steps of [1] to [3].

* * * * *